US007591314B2

(12) United States Patent
Sonnier et al.

(10) Patent No.: US 7,591,314 B2
(45) Date of Patent: Sep. 22, 2009

(54) MEASUREMENT-WHILE-FISHING TOOL DEVICES AND METHODS

(75) Inventors: James A. Sonnier, Houston, TX (US); Robbie B. Colbert, Perdido, AL (US); James W. Anderson, Katy, TX (US); Gerald Heisig, Celle (DE); Blake C. Pizzolato, Montgomery, TX (US); Johnny C. Hicks, Keller, TX (US)

(73) Assignee: Baker Hughes Incorporated, Houston, TX (US)

( * ) Notice: Subject to any disclaimer, the term of this patent is extended or adjusted under 35 U.S.C. 154(b) by 562 days.

(21) Appl. No.: 10/776,089

(22) Filed: Feb. 11, 2004

(65) Prior Publication Data

US 2004/0251027 A1 Dec. 16, 2004

Related U.S. Application Data

(60) Provisional application No. 60/447,771, filed on Feb. 14, 2003.

(51) Int. Cl.
*E21B 31/00* (2006.01)
*E21B 31/18* (2006.01)

(52) U.S. Cl. ..... 166/301; 166/117.7; 166/66

(58) Field of Classification Search ..... 166/297, 166/55.1, 277, 301, 377, 380, 378, 98, 99, 166/178, 339, 117.7, 66; 340/853.3, 853.4, 340/853.9, 853.8, 854.2
See application file for complete search history.

(56) References Cited

U.S. PATENT DOCUMENTS 2,745,345 A * 5/1956 Sweetman ..... 166/63
3,268,003 A * 8/1966 Essary ..... 166/284
3,994,163 A * 11/1976 Rogers ..... 73/152.56
4,299,279 A * 11/1981 Bodine ..... 166/72
4,448,250 A * 5/1984 Cooke et al. ..... 166/255.1
4,617,960 A * 10/1986 More ..... 137/554
RE32,336 E 1/1987 Escaron et al. ..... 166/250
4,805,449 A 2/1989 Das ..... 73/151
5,195,588 A 3/1993 Dave ..... 166/255
5,318,125 A 6/1994 Wittrisch ..... 166/277
5,370,183 A * 12/1994 Ellis et al. ..... 166/277
5,375,476 A 12/1994 Gray ..... 73/862.331
5,404,944 A * 4/1995 Lynde et al. ..... 166/117.7
5,477,921 A * 12/1995 Tollefsen ..... 166/250.13
5,984,009 A * 11/1999 DiFoggio ..... 166/250.13
5,988,992 A * 11/1999 Tetzlaff et al. ..... 417/360
6,021,377 A 2/2000 Dubinsky et al. ..... 702/9
6,041,860 A * 3/2000 Nazzal et al. ..... 166/250.01
6,050,349 A 4/2000 Rountree et al.

(Continued)

FOREIGN PATENT DOCUMENTS

EP 0552087 A2 7/1993

(Continued)

*Primary Examiner*—Kenneth Thompson
(74) *Attorney, Agent, or Firm*—Mossman, Kumar & Tyler, PC

(57) ABSTRACT

Methods and devices for sensing operating conditions associated with downhole, non-drilling operations, including, fishing and retrieval operations as well as underreaming or casing cutting operations and the like. A condition sensing device is used to measure downhole operating parameters, including, for example, torque, tension, compression, direction of rotation and rate of rotation. The operating parameter information is then used to perform the downhole operation more effectively.

16 Claims, 6 Drawing Sheets

U.S. PATENT DOCUMENTS

| | | | | |
|---|---|---|---|---|
| 6,112,809 | A | 9/2000 | Angle | 166/66 |
| 6,158,512 | A * | 12/2000 | Unsgaard | 166/311 |
| 6,233,524 | B1 | 5/2001 | Harrell et al. | 702/9 |
| 6,286,596 | B1 * | 9/2001 | Schnatzmeyer et al. | 166/250.15 |
| 6,536,524 | B1 | 3/2003 | Snider | 166/297 |
| 6,729,406 | B1 * | 5/2004 | Collins et al. | 166/297 |
| 6,848,506 | B1 * | 2/2005 | Sharp et al. | 166/301 |
| 2003/0024702 | A1 | 2/2003 | Gray et al. | 166/301 |
| 2003/0075327 | A1 | 4/2003 | Stolarczyk | 166/298 |
| 2003/0075329 | A1 | 4/2003 | Day et al. | 166/301 |
| 2005/0269081 | A1 * | 12/2005 | Rose | 166/255.1 |

FOREIGN PATENT DOCUMENTS

| | | | |
|---|---|---|---|
| GB | 2231357 | A * | 11/1990 |
| GB | 2349403 | A | 1/2000 |
| WO | WO03/012250 | A | 2/2003 |

* cited by examiner

MEASUREMENT-WHILE-FISHING TOOL DEVICES AND METHODS

This application claims the priority of U.S. Provisional patent application Ser. No. 60/447,771 filed Feb. 14, 2003.

BACKGROUND OF THE INVENTION

1. Field of the Invention

The invention relates generally to methods and devices for detecting wellbore and tool operating conditions while engaged in fishing or other downhole manipulation operations to remove a wellbore obstruction or in other non-drilling applications, especially in very deep and/or deviated wellbores.

2. Description of the Related Art

Devices are known for measurement-while-drilling (MWD) and logging-while-drilling (LWD) wherein certain borehole conditions are measured and either recorded within storage media within the wellbore or transmitted to the surface using encoded transmission techniques, such a frequency shift keying (FSK). Transmission may be accomplished via radio waves or fluid pulsing within drilling mud. The conditions measured typically include temperature, annulus pressure, drilling parameters, such as weight-on-bit (WOB), rotational speed of the drill bit and/or the drill string (RPMs), and the drilling fluid flow rate. An MWD or LWD sub is incorporated into the drill string above the bottom hole assembly and then operated during drilling operations. Examples of drilling systems that utilize MWD/LWD technology are described in U.S. Pat. Nos. 6,233,524 and 6,021,377, both of which are owned by the assignee of the present invention and are incorporated herein by reference.

Aside from typical drilling operations, there are other situations where it is helpful to have certain information relating to operation of the tool that is operating downhole and its environment. In very deep and/or high angle wellbores, it is difficult to verify details concerning the operation of the downhole tools through surface indications alone. For example, if one were attempting to remove a stuck section of casing in a deep and/or deviated wellbore using a rotary milling device, it would be very helpful to be able to measure the amount of torque induced proximate the milling device. Without an indication of the amount of torque induced proximate the milling device, the milling string can be overtorqued at the surface and the string between the milling tool and the surface will absorb the torque forces without effectively transmitting them to the milling tool. Overtorquing the tool string in this situation may lead to a shearing of the tool string below the surface, thereby creating an obstruction that is even more difficult to remove.

To the inventors' knowledge, there are no known, acceptable devices for providing useful downhole operating condition information, including torque, weight, compression, tension, speed of rotation, and direction of rotation, in non-drilling situations. Further, the use of standard MWD tools for such non-drilling applications is quite expensive. Current MWD tools are designed to obtain significant amounts of borehole information, much of which is not relevant outside of a drilling scenario. The devices for collecting this drilling specific information includes nuclear sensors, such as gamma ray tools for determining formation density, nuclear porosity and certain rock characteristics; resistivity sensors for determining formation resistivity, dielectric constant and the presence or absence of hydrocarbons; acoustic sensors for determining the acoustic porosity of the formation and the bed boundary in formation; and nuclear magnetic resonance sensors for determining the porosity and other petrophysical characteristics of the formation. To the inventors' knowledge, there is no known and acceptable "fit-for-purpose" tool wherein the sensor portion of the tool may be customized to detect those data that are important to the job at hand while not detecting irrelevant or less relevant information.

There is a need for improved devices and methods that are capable of providing operating condition information to the surface in non-drilling situations. There is also a need for improved methods and devices for accomplishing fishing and retrieval-type operations. Additionally, there is a need for improved methods and devices for accomplishing other non-drilling applications, such as underreaming, in-hole casing cutting and the like. The present invention addresses the problems of the prior art.

SUMMARY OF THE INVENTION

The invention provides methods and devices for sensing operating conditions associated with downhole, non-drilling operations, including, fishing, but also with retrieval operations as well as underreaming or casing cutting operations and the like. In currently preferred embodiments, a condition sensing device is used to measure downhole operating parameters, including, for example, torque, tension, compression, direction of rotation and rate of rotation. The operating parameter information is then used to perform the downhole operation more effectively.

In one embodiment, a memory storage medium is contained within the tool proximate the sensors. The detected information is recorded and then downloaded after the tool has been removed from the borehole. In a further embodiment, the detected information is encoded and transmitted to the surface in the form of a coded signal. A receiver, or data acquisition system, at the surface receives the encoded signal and decodes it for use. Means for transmitting the information to the surface-based receiver include mud-pulse telemetry and other techniques that are useful for transmitting MWD/LWD information to the surface. In a further aspect of the invention, a controller is provided for adjusting the downhole operation in response to one or more detected operating conditions.

The invention provides for an inexpensive condition sensing tool that is useful in a wide variety of situations. The invention also provides a "fit-for-purpose" tool that may be easily customized to collect and provide desired operating condition information without collecting undesired information. In related aspects, the invention also provides for improved method of conducting non-drilling operations within a borehole, including fishing operations, wherein measured downhole operating condition information is used to improve the non-drilling operation and make it more effective.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
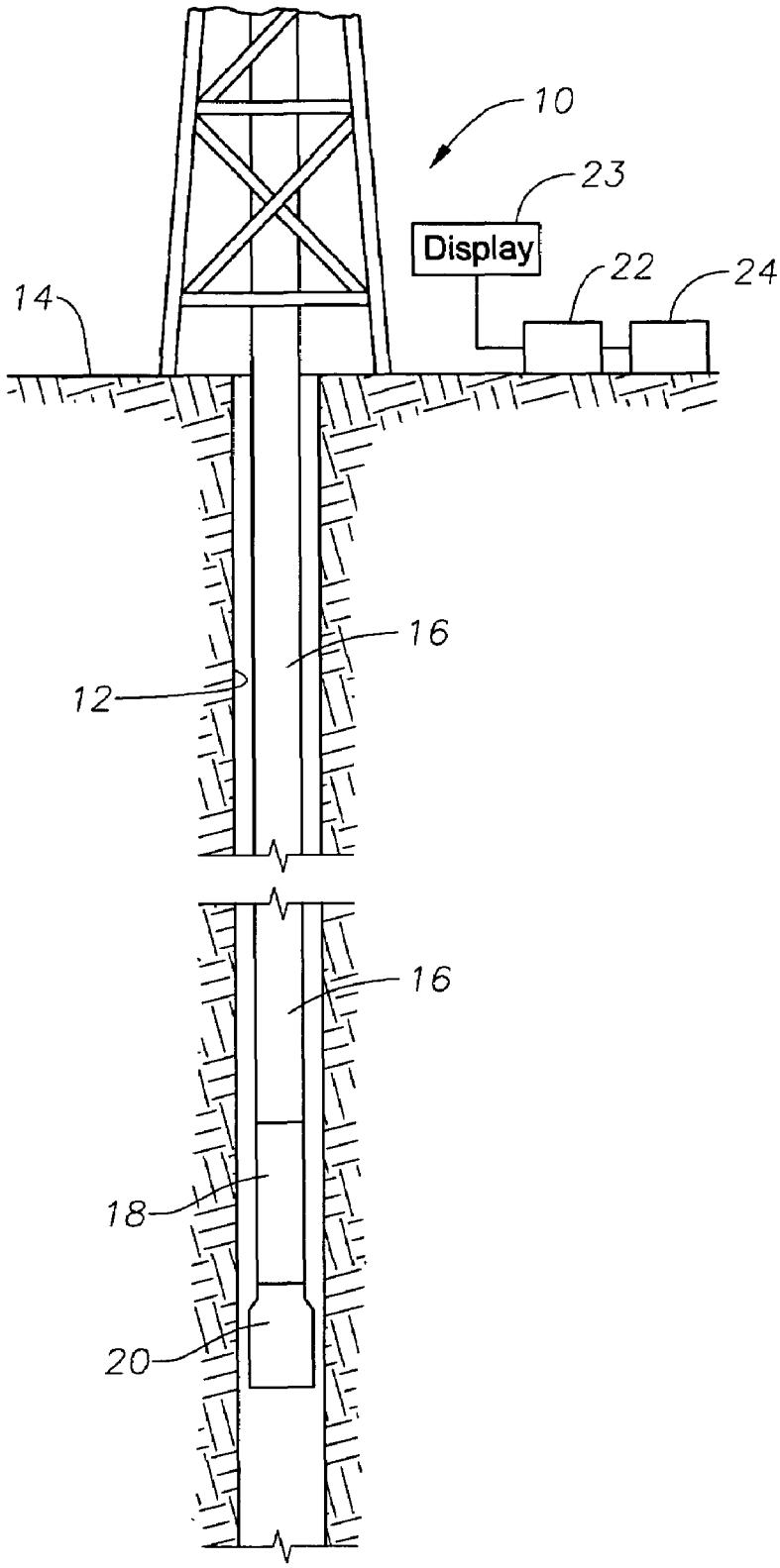
FIG. 1 is a schematic, cross-sectional view of an exemplary wellbore employing a tool and tool assembly constructed in accordance with the present invention.

FIG. 1 is a schematic drawing depicting, in general terms, the structure and operation of a tool and tool assembly constructed in accordance with the present invention as well as methods and systems in accordance with the present invention. These tools, tool assemblies, systems and methods may be referred to herein for shorthand convenience as "measurement-while-fishing" systems, although this term is not intended to limit the invention to "fishing" applications. Those of skill in the art will understand that there are, in fact, numerous non-drilling applications for the systems, methods and devices of the present invention.

FIG. 1 shows a rig 10 for a hydrocarbon well 12. It will be understood that, while a land-based rig 10 is shown, the systems and methods of the present invention are also applicable to offshore rigs, platforms and floating vessels. From the rig 10, a borehole 12 extends downwardly from the surface 14. A tool string 16 is shown disposed within the borehole 12. The tool string 16 may comprise a string of drill pipe sections, production tubing sections or coiled tubing. The tool string 16 is tubular and defines a bore therein through which drilling mud or other fluid may be pumped. Although not depicted in FIG. 1, the rig 10 includes means for pumping drilling fluid or other fluid into the tool string 16 as well as means for rotating the tool string 16 within the borehole 12. At the lower end of the tool string 16 there is secured a condition sensing tool 18, the lower end of which is, in turn, affixed to a workpiece 20. The workpiece 20 refers generally to a tool or device that is performing a function within the borehole 12 and for which certain operational data is desired at the surface 14. As will be understood by reference to the exemplary embodiments described shortly, the workpiece 20 may comprise a fishing device, such as a jarring tool or latching mechanism, or a cutting tool, such as an underreamer or casing cutter, or other device.

It is noted that the borehole 12 may extend rather deeply below the surface (i.e., 30,000 feet or more) and, while shown in FIG. 1 to be substantially vertically oriented, may actually be deviated or even horizontal along some of its length. At the surface 14 is a data acquisition system 22 and a controller 24. An operator at the surface typically controls operation of the workpiece 20 by adjusting such parameters as weight on the workpiece, fluid flow through the tool string 16, rate and direction of rotation of the tool string 16 (if any) and so forth.

Figure 2:
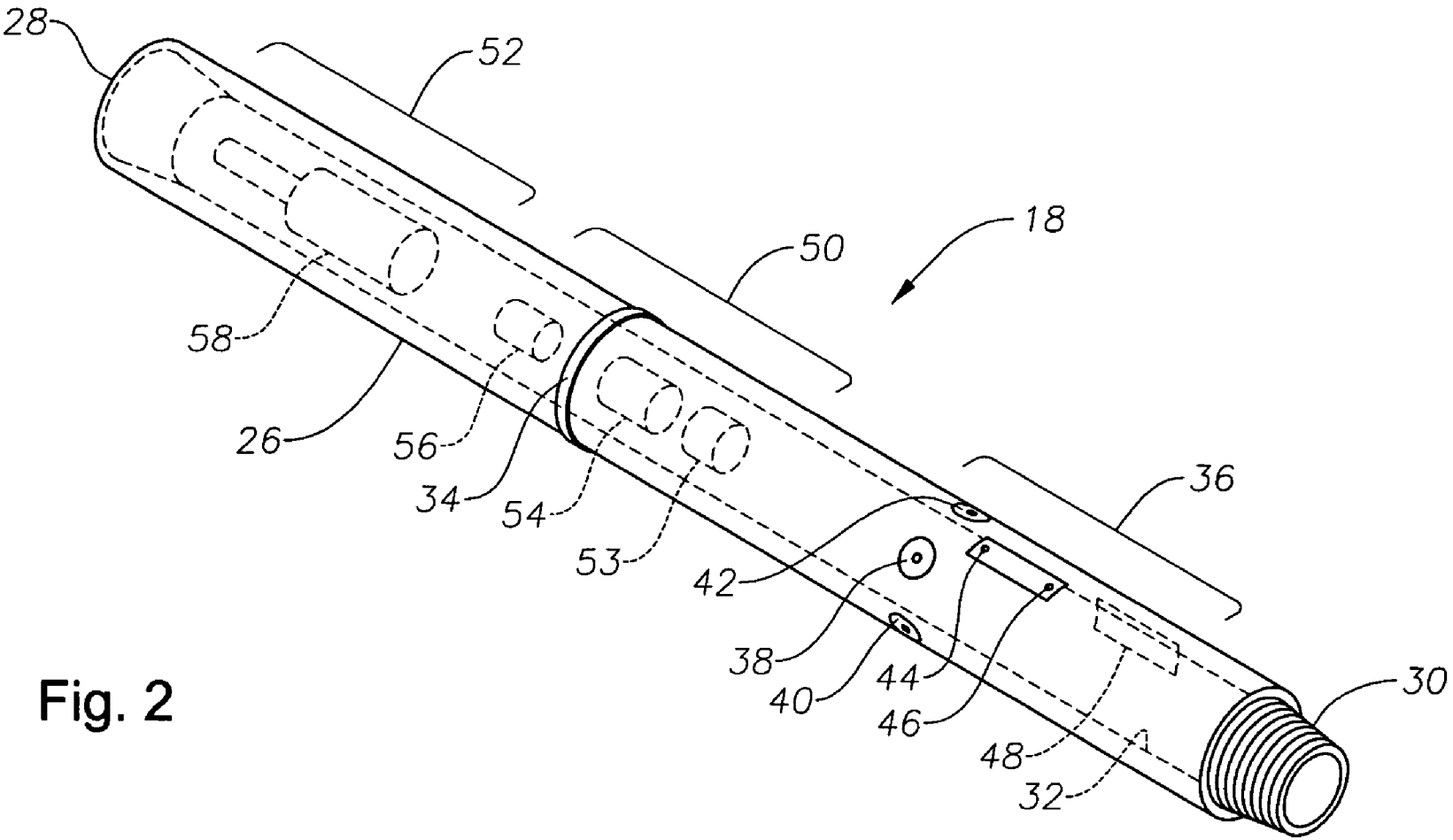
FIG. 2 is an isometric view, partially in cross-section, of an exemplary condition-sensing tool constructed in accordance with the present invention.

Referring now to FIG. 2, there is shown in cross-section details for the construction and operation of an exemplary condition-sensing tool 18 constructed in accordance with the present invention. The tool 18 includes a generally cylindrical outer housing 26 having axial ends 28, 30 that are configured for threaded engagement to adjoining portions of the tool string 16 and the workpiece 20. The housing 26 defines a flowbore 32 therethrough to permit the passage of drilling fluid or other fluid. One or more wear pads 34 may be circumferentially secured about the tool 18 to assist in protection of the tool 18 from damage caused by borehole friction and engagement. The tool 18 includes a sensor section 36 having a plurality of condition sensors mounted thereupon. In the exemplary tool 18 shown, the sensor section 36 includes a weight sensor 38 that is capable of determining the amount of weight exerted by the tool string 16 upon the workpiece 20 and a torque gauge 40 that is capable of measuring torque exerted upon the workpiece 20 by rotation of the tool string 16. Additionally, the sensor section 36 includes an angular bending gauge 42, which is capable of measuring angular deflection or bending forces within the tool string 16. Additionally, the sensor section 36 includes an annulus pressure gauge 44, which measures the fluid pressure within the annulus created between the housing 26 and the borehole 12. A bore pressure gauge 46 measures the fluid pressure within the bore 32 of the tool 18. While the operable electrical interconnections for each of these sensors is not illustrated in FIG. 2, such are well known to those of skill in the art and, thus, will not be described in detail herein. An accelerometer 48 is illustrated as well that is operable to determine acceleration of the tool 18 in an axial, lateral or angular direction. Through each of the above described sensors, the sensor section 36 obtains and generates data relating to the operating parameters of the workpiece 20.

In a currently preferred embodiment, the condition sensing tool 18 may comprise portions of a CoPilot® MWD tool, which is available commercially from the INTEQ division of Baker Hughes, Incorporated, Houston, Tex., the assignee of the present application. It is noted that the condition sensing tool 18 does not require, and typically will not include, those components and assemblies that are useful primarily or only in a drilling situation. These would include, for example, gamma count devices and directional sensors used to orient the tool with respect to the surrounding formation. This greatly reduces the cost and complexity of the tool 18 in comparison to traditional MWD or LWD tools. It is intended that the tool 18 be a "fit-for-purpose" tool that is constructed to have those sensors that are desired for a given job but not others that are not required. As a result, the cost and complexity of the tool 18 is minimized.

The tool 18 also includes a processing section 50 and a power section 52. The processing section 50 is operable to receive data concerning the operating conditions sensed by the sensor section 36 and to store and/or transmit the data to a remote receiver, such as the receiver or data acquisition system 22 located at the surface 14. The processing section 50 preferably includes a digital signal processor 53 and storage medium, shown at 54, which are operably interconnected with the sensor section 36 to store data obtained from the sensor section 36. The processor 53 (also referred to as the "control unit" or a "processing unit") includes one or more microprocessor-based circuits to process measurements made by the sensors in the drilling assembly at least in part, downhole during drilling of the wellbore.

The processor section 50 also includes a data transmitter, schematically depicted at 56. The data transmitter 56 may comprise a mud pulse transmitter, of a type known in the art, for transmitting encoded data signals to the surface 14 using mud pulse telemetry. The data transmitter 56 may also comprise other transmission means known in the art for transmitting such data to the surface.

The power section 52 houses a power source 58 for operation of the components within the processor section 50 and the sensor section 36. In a currently preferred embodiment, the power source 58 is a "mud motor" mechanism that is actuated by the flow of drilling fluid or another fluid downward through the tool string 16 and through the bore 32 of the tool 18. Such mechanisms utilize a turbine that is rotated by a flow of fluid, such as drilling mud, to generate electrical power. An example of a suitable mechanism of this type is the power source assembly within the 4¾" CoPilot® tool that is sold commercially by Baker Hughes INTEQ. Other acceptable power sources may also be employed, such as batteries where, for example, fluid in not flowed during the particular downhole operation being performed.

Figure 3:
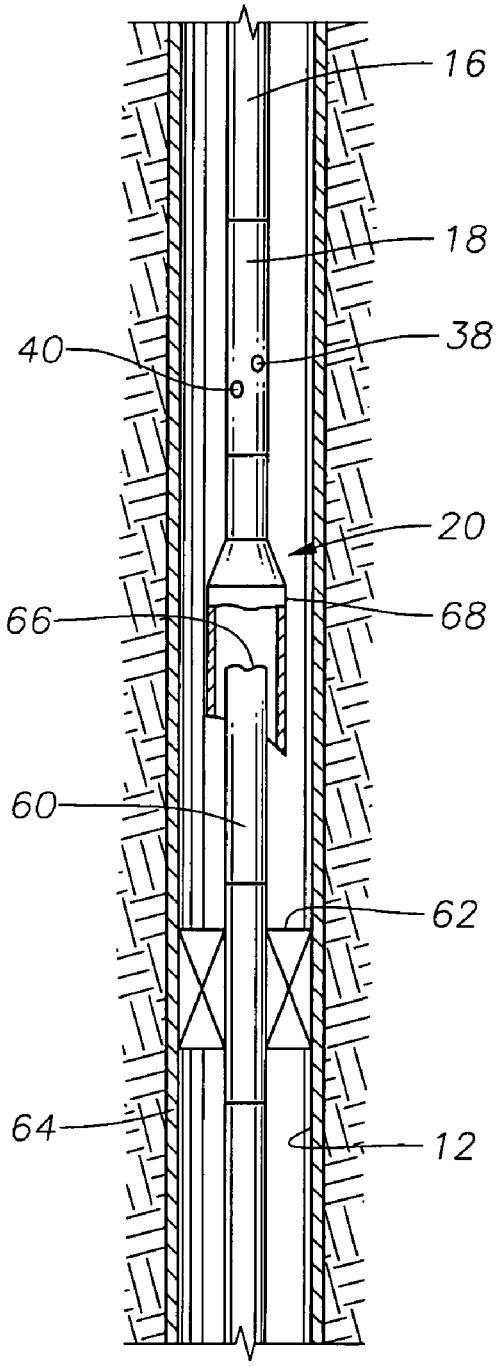
FIG. 3 is a side cross-sectional, schematic depiction of an illustrative fishing application wherein a section of production tubing and packer are being removed from a borehole, in accordance with the present invention.

A number of exemplary methods and arrangements for implementing the present invention will now be described in order to illustrate the systems and method of the invention. FIG. 3 depicts a situation wherein it is necessary to fish a section of production tubing 60 and a retrievable packer 62 out of the borehole 12. This type of fishing operation may be necessary where the production tubing 60 has developed a breach above the location of the packer 62, and the packer 62 cannot be released using its intended release mechanism. In FIG. 3, the borehole 12 is shown lined with casing 64, and the packer 62 is sealed against the inner wall of the casing 64. The upper end 66 of the production tubing section 60 has been cut off in an uneven fashion and the upper portion of the production tubing string leading to the surface 14 has been removed.

A tool string 16, which in this instance may comprise a string of production tubing or coiled tubing, is then lowered into the borehole 12 as shown in FIG. 3. The condition sensing tool 18 is secured to the lower end of the tool string 18. In this arrangement, the tool 18 is configured to have at least a weight sensor 38 and torque gauge or sensor 40. Affixed to the lower end of the tool 18 is an engagement device 68, which serves as the workpiece 20. The engagement device 68 is a fishing tool, of a type known in the art, which is configured to engage the upper end 66 of the production tubing section 60. Then, by pulling upwardly upon, jarring, pressuring up within, and/or by rotating the tool string 16, the production tubing section 60 and the packer 62 are removed from the borehole 12.

In operation, the weight sensor 38 of the tool 18 detects the amount of upward force exerted upon the engagement device 68 from upward pull on the tool string 16. If rotation of the tool string 16 is applied in an attempt to remove the tubing string section 60 and packer 62, then the torque gauge 40 will detect the amount of torque from this rotation that is actually felt at the engagement tool 68. Alternatively, if the tool string 16 is pressured up in order to help release the tubing string section 60 and packer 62, detection of bore pressure and annulus pressure would be desirable. This data is then either stored or transmitted to the surface 14 so that an operator can detect whether there is a significant discrepancy between the upward or rotational force being applied at the surface and the forces being received proximate the workpiece 20. A significant difference may be indicative of a problem that prevents full transmission of such forces, such as an obstruction in the annulus or the tool string 16 being grounded against the borehole 12 in a deviated and/or extremely deep portion of the borehole 12.

Figure 4:
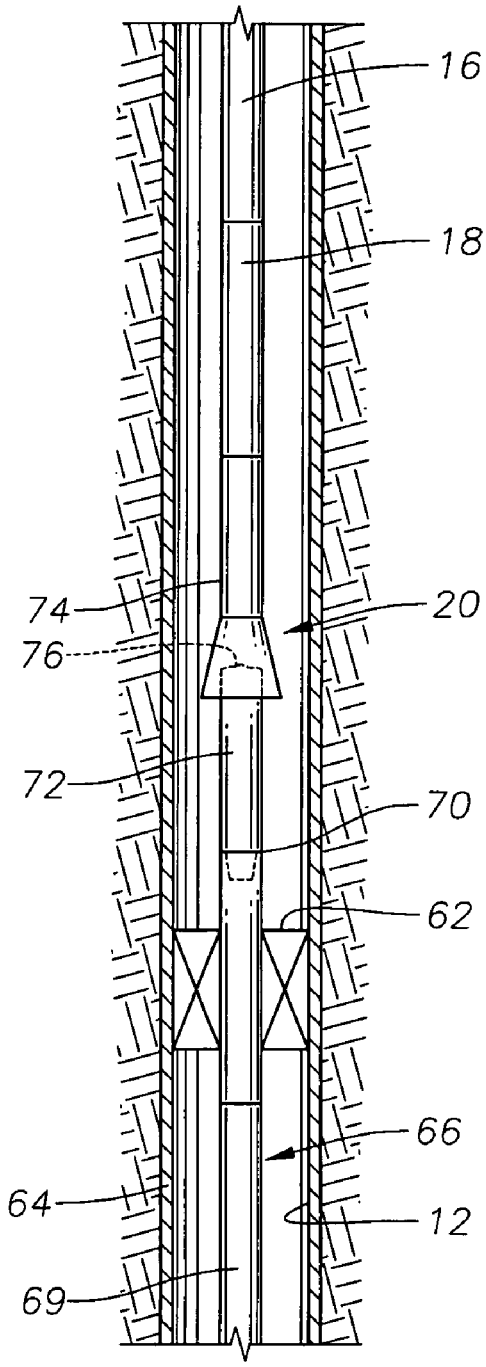
FIG. 4 is a side cross-sectional, schematic depiction of an illustrative backoff operation conducted in accordance with the present invention.

Referring now to FIG. 4, there is shown an illustrative anchor latch or threaded arrangement wherein the utility of the devices and methods of the present invention is shown for performing disconnection of threaded components within the borehole 12. In this instance, a packer element 62 is shown secured against the casing 64 of the borehole 12 and retains a production tubing portion 66 that includes a lower tubing section 69 that is secured by threaded connection 70 to an upper tubing section 72. The upper tubing section 72 has been cut away as with the production tubing section 60 described earlier. An engagement tool 74, herein serving as the workpiece 20, is secured to the condition sensing tool 18 and is configured to fixedly engage the upper end 76 of the upper tubing section 72. Such an engagement tool 74 is known in the art. It is desired to unthread the threaded connection 70 so that the upper tubing string section can be removed from the borehole 12 and replaced with another tubing string section which can then be threadedly engaged with the lower tubing section 69 to reestablish production within the borehole 12. Unthreading of the threaded connection 70 depends upon lifting up on the tool string 16 until the compression force, or weight, upon the threaded connection 70 is essentially zero. Otherwise, the threaded connection 70 will be difficult, if not impossible to unthread. Attempting to do so may, in fact, damage the thread, making it impossible to attach another production tubing section later. Conversely, too much lifting up on the tool string 16 will also cause the threaded connection 70 to be difficult or impossible to unthread though rotation of the tool string 16. Therefore, it is important to be able to sense and determine the amount of tension and compression that is felt proximate the engagement tool 74 with some accuracy. Therefore, the condition sensing tool 18 is configured to sense, at least, weight and torque. In operation, the engagement tool 74 is latched onto the upper section 72 and the operator pulls upward or slacks off on the tool string 16 until the weight reading is essentially zero, indicating that unthreading of the threaded connection 70 may begin. The tool string 16 is then rotated in the direction necessary to unthread the connection 70. Torque readings from the tool 18 will indicate whether there is a problem in transmitting the rotational forces from rotating the tool string 16 to the engagement tool 74.

Figure 5:
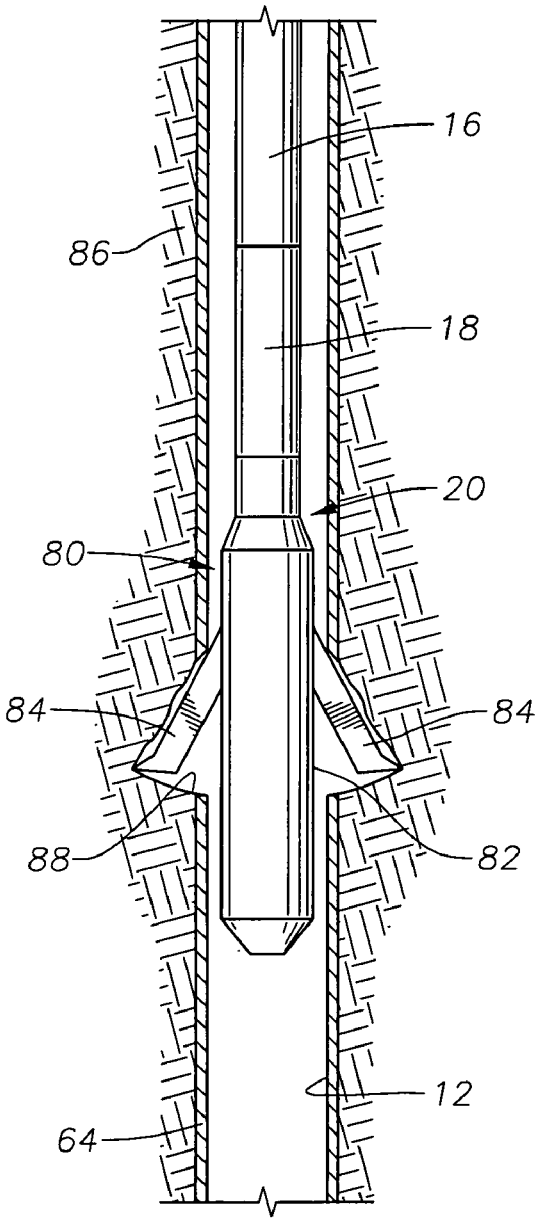
FIG. 5 is a schematic side, cross-sectional view of an illustrative casing cutting arrangement conducted in accordance with the present invention.

FIG. 5 illustrates a situation wherein a portion of wellbore casing 64 is being cut by a casing cutter 80. Those of skill in the art will understand that it could as easily apply to the cutting of production tubing. The casing cutter 80 is secured to the lower end of the condition sensing tool 18 and includes, essentially a central tubular body 82 with a pair of radially extending cutters 84. Such cutting tools are well known in the art and are used only in order to illustrate the invention and, therefore, will not be described in detail herein. The casing cutter 80 is shown cutting through the casing 64 and into the surrounding formation 86 by cutters 84. Because the casing cutter 80 is rotated by rotation of the tool string 16, it is important to know the direction of rotation, the speed of rotation (RPM), as well as the weight on the casing cutter 80. In operation, the tool string 16 is rotated to cause the casing cutter 80 to cut the casing 64 to form an opening 88. The tool 18 is configured to sense at least the speed (RPM) and direction of rotation proximate the casing cutter 80 to ensure that the opening 88 is properly cut. Measurements of the torque applied to the casing cutter 80 and weight upon the casing cutter 80 are also important and are preferably sensed by the tool 18.

Figure 6:
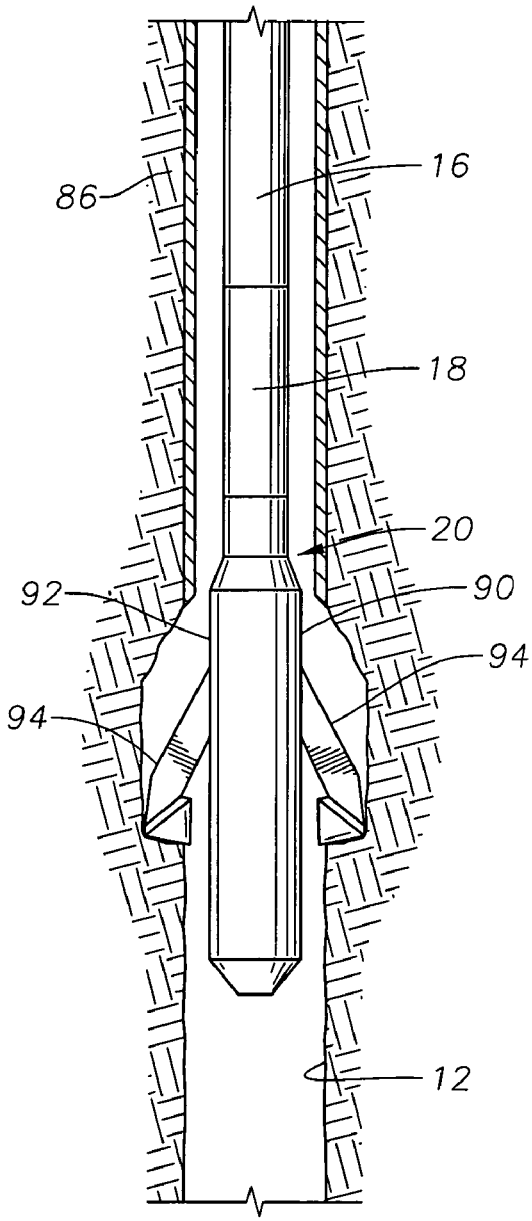
FIG. 6 is a schematic side, cross-sectional view of an illustrative underreaming arrangement conducted in accordance with the present invention.

Referring now to FIG. 6, an underreaming situation is illustrated that incorporates the devices and methods of the present invention. An underreamer device 90 is affixed to the lower end of the tool 18. The underreamer device 90, as is known in the art, includes a tubular body 92 with a plurality of underreamer arms 94 which are pivotally connected to the body 92 and move radially outwardly to cut the formation 86 when the underreamer body 92 is rotated about its longitudinal axis. Underreaming is used when it is desired to enlarge the diameter of the borehole 12 at a certain point. In an underreamer operation, it is important to monitor the torque forces proximate the underreamer 90. Thus, the tool 18 is configured to at least sense torque forces proximate the underreamer 90. Preferably, the tool 18 is also configured to sense weight, rate of rotation (RPM), and direction of rotation.

Figure 7:
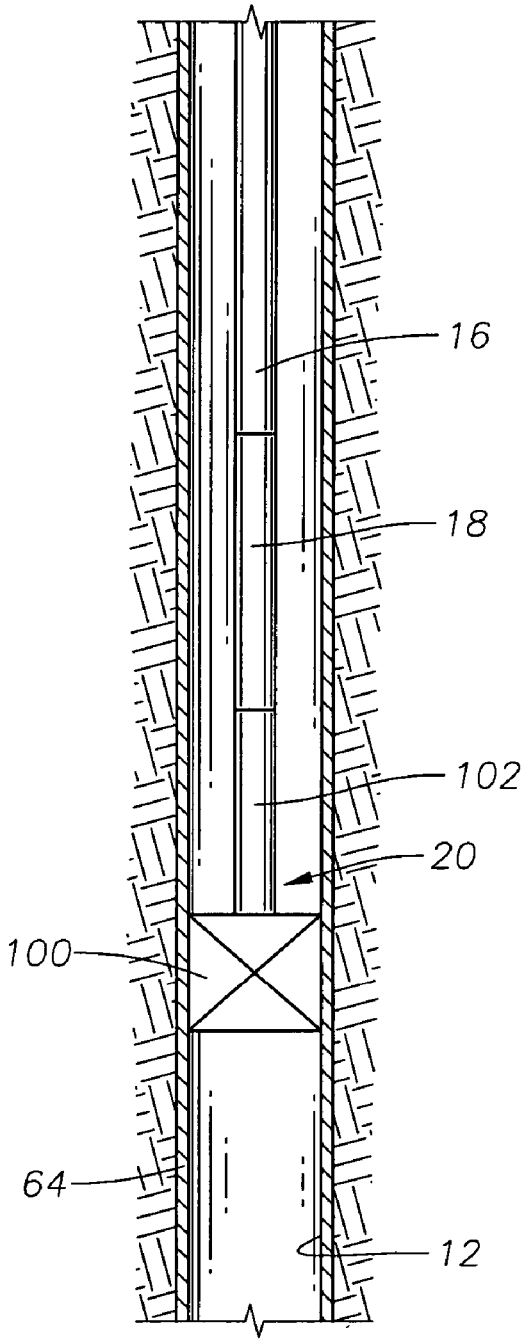
FIG. 7 is a schematic side, cross-sectional view of an illustrative fishing application for removal of a packer from within a borehole, conducted in accordance with the present invention.

Turning now to FIG. 7, there is shown an arrangement wherein a packer 100 is being retrieved from a set position within the borehole 12. The condition sensing tool 18 is secured to the lower end of the tool string 16, and an engagement tool 102 is affixed to the lower end of the condition sensing tool 18. The engagement tool 102 is configured to latch onto the packer 100 and unset it for removal from the borehole 12. The tool string 16 is lowered into the borehole 12 until the engagement tool 102 becomes securely latched onto the packer 100. The packer 100 is typically released from engagement with the wall of the borehole 12 by pulling upwardly on the tool string 16 and/or by rotating the tool string 16 so as to apply tension and torque to the packer 100. In this instance, then, the tool 18 should be configured to measure at least tension/compression (weight) and torque proximate the packer 100.

Figure 8:
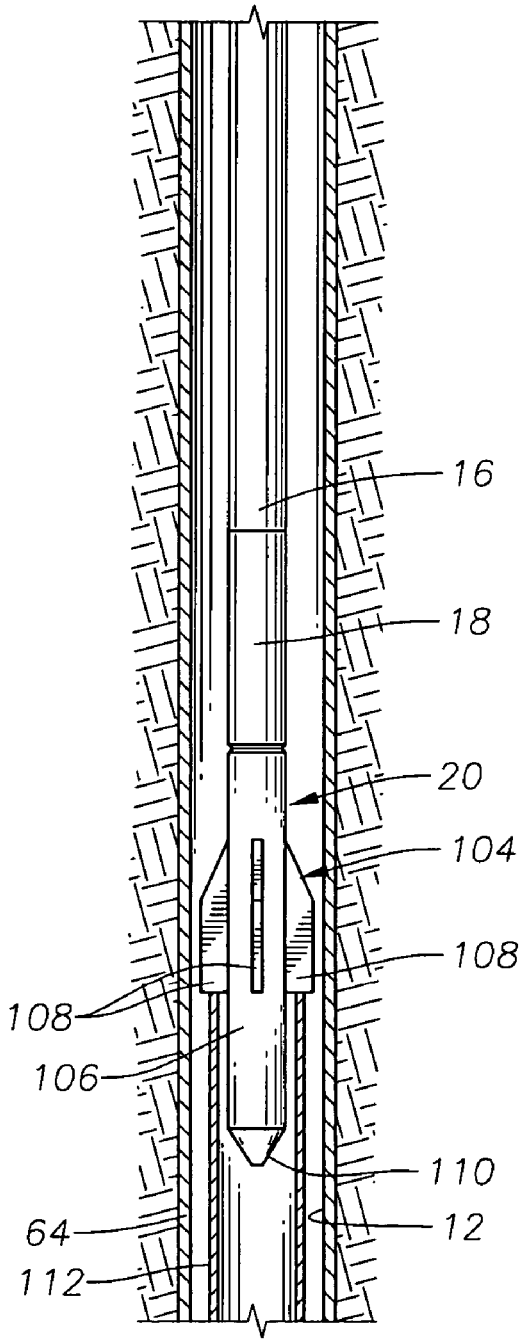
FIG. 8 is a schematic side, cross-sectional view of an illustrative pilot milling application conducted in accordance with the present invention.

FIG. 8 illustrates an exemplary pilot milling arrangement wherein a rotary pilot mill 104 is secured to the condition sensing tool 18 and tool string 16. The mill 104 has a generally cylindrical central body 106 with a number of radially-extending milling blades 108. The body 106 presents a nose section 110. The mill 104 is shown in contact with the upper end of a tubular member 112 that has become stuck in the borehole 12. It is desired to mill away the tubular member 112 by rotation of the mill 104 so as to cause the milling blades 108 to cut the tubular member 112 away. Thus, the mill 104 is set down atop the tubular member 112 so that the nose 110 is inserted into the tubular member 112 and the blades 108 contact the upper end of the tubular member 12. During operation, drilling mud is circulated down through the tool string 16, tool 18 and mill 104. The drilling mud exits the mill 104 proximate the location where the blades 108 contact the tubular member 112 and serves to lubricate the cutting process and/or provide a means to circulate cuttings to the surface via the wellbore fluid in the annulus.

In milling operations such as the one shown in FIG. 8, it is helpful to be able to detect the torque forces, direction of rotation, weight (i.e., axial tension and/or compression forces exerted on the mill by the tool string 16), and speed of rotation for the mill 104. Thus, the tool 18 should be configured to at least detect these downhole operating parameters. Additionally, the amount of bounce of the mill 104 may be determined by incorporating a vibration sensor (not shown), of a type known in the art, into the sensor section 36 of the tool 18. The sensed information is then used to make adjustments to the milling procedure (i.e., a change in RPM, setting down on or lifting up on the mill) to improve the milling procedure.

Figure 9:
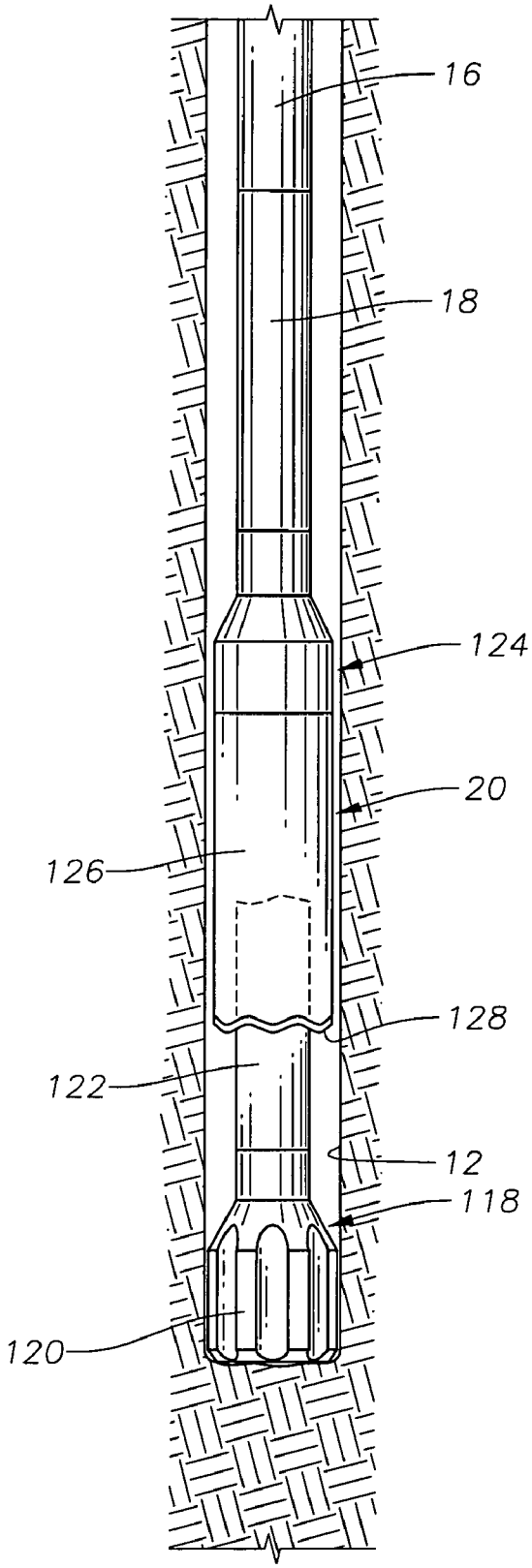
FIG. 9 is a schematic side, cross-sectional view of an illustrative washover retrieval operation for retrieval of a stuck bottom hole assembly, conducted in accordance with the present invention.

FIG. 9 illustrates a washover retrieval operation incorporating devices and method of the present invention. In this instance, a bottom hole assembly (BHA) 118 has become stuck in the borehole 12. The BHA 118 includes a drill bit 120 and drill pipe section 122 extending upwardly therefrom. The drill pipe section 122 is a stub portion of the drill pipe string that remains after the rest of the drill string has been cut away and removed. The BHA 118 is but one example of a component that might become stuck in the wellbore. Other components that might become lodged or stuck in the borehole 12 include screens, liners, drill pipe sections, tubing sections and so forth.

Secured to the lower end of the tool string 16 is the condition sensing tool 18 and a washover tool 124, which serves as the workpiece 20. The washover tool 124 includes a rotary shoe 126 with annular cutting edge 128 that is designed for cutting away the formation around the stuck BHA 118. In this way the stuck component 118 is washed over and easier to remove. In this operation, it is desirable to know, in particular, the torque forces experienced proximate the washover tool 124. Thus, the condition sensing tool 18 should be configured to sense at least torque forces. Preferably, the tool 18 is also configured to sense RPM and direction of rotation in order to help prevent inadvertent twisting off of or damage to the washover tool 124 or to the stuck component.

It is noted that the data acquisition system 22 preferably includes a graphical display, 23 in FIG. 1, of a type known in the art, thereby permitting a human operator to observe indications of downhole operating conditions and make adjustments to the downhole operation (i.e., by adjusting the rate of rotation or set down weight) in response thereto. The effect of the adjustment will be detected by the downhole sensors of the tool 18 and then transmitted to the surface 14 where it will be received by the data acquisition system 22. Thus, it can be seen that a closed-loop system is provided for control of non-drilling applications based upon sensed data.

It is further noted that the display and data acquisition system 22 may comprise a suitably programmed personal computer, as opposed to the "rigfloor" displays that are associated with MWD and LWD systems. Because there are fewer and less complex parameters to measure and monitor than with a typical MWD or LWD system, a less complex and expensive display and acquisition system is required.

In a further aspect of the invention, automated or semi-automated control of the non-drilling processes is possible utilizing a closed loop system. The processor 53 processes measurements made by the sensors in the condition sensing tool 18, at least in part, downhole during operations within the wellbore 12. The processed signals or the computed results are transmitted to the surface 14 by the transmitter 56 of the condition-sensing tool 18. These signals or results are received at the surface 14 by the data acquisition system 22 and provided to the controller 24. The controller 24 then controls downhole operations in response to the signals or results provided to it.

The processor 53 may also control the operation of the sensors and other devices in the tool string 16. The processor 53 within the tool 18 may also process signals from the various sensors in the condition sensing tool 18 and also control their operation. The processor 53 also can control other devices associated with the tool 18, such as the devices casing cutter 80 or the underreamer 90. A separate processor may be used for each sensor or device. Each sensor may also have additional circuitry for its unique operations. The processor 53 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and may provide two-way data and signal communication between the tool 18 and the surface 14 equipment via two-way mud pulse telemetry.

The surface controller 24 receives signals from the downhole sensors and devices and processes such signals according to programmed instructions provided to the controller 24. The controller 24 displays desired drilling parameters and other information on a display/monitor 23 that is utilized by an operator to control the drilling operations. The controller 24 preferably contains a computer, memory for storing data, recorder for recording data and other necessary peripherals. The controller 24 may also include a simulation model and processes data according to programmed instructions. The controller 24 may also be adapted to activate alarms when certain unsafe or undesirable operating conditions occur.

While, in the described embodiments, the condition sensing tool 18 is shown to be directly connected to the workpiece 20, this may not always be so. It is possible that a cross-over tool or some other component may be secured intermediately between the workpiece 20 and the tool 18.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A system for detecting a downhole condition in a wellbore during a non-drilling wellbore operation, the system comprising:

a tool string formed of a tubular to be disposed within the wellbore;

a fishing device configured to be conveyed into the wellbore using the tool string;

at least one sensor along the tool string for sensing the downhole condition, the at least one sensor configured to be conveyed into the wellbore with the fishing device using the tool string; and a processing section for receiving data relating to the downhole condition.

2. A method of performing a non-drilling downhole wellbore operation comprising:

integrating a workpiece and a condition sensing tool into a tool string;

disposing the tool string into a wellbore;

actuating the workpiece to conduct a non-drilling downhole operation;

detecting at least one downhole condition with the condition sensing tool while operating the workpiece;

receiving data relating to the at least one downhole condition within a processing section of the condition sensing tool; and rotating the tool string.

3. A system for detecting a downhole condition in a wellbore during a non-drilling wellbore operation, the system comprising:

a tool string formed of a tubular to be disposed within the wellbore, wherein the tool string is configured to rotate;

a workpiece configured to be conveyed into the wellbore using the tool string, the workpiece configured to perform the non-drilling wellbore operation within the wellbore;

at least one sensor along the tool string for sensing the downhole condition, the condition sensing tool configured to be conveyed into the wellbore with the workpiece using the tool string; and a processing section for receiving data relating to the downhole condition.

4. The system of claim 3, further comprising:

a transmitter associated with the processing section and configured to transmit the data relating to the downhole condition to the surface.

5. The system of claim 4 wherein the workpiece comprises a cutting tool.

6. The system of claim 5 wherein the cutting tool comprises an underreamer.

7. The system of claim 5 wherein the cutting tool comprises a casing cutter.

8. The system of claim 3, further comprising a power section.

9. The system of claim 1, wherein the transmitter uses mud pulse telemetry.

10. A system for detecting a downhole condition in a wellbore during a non-drilling wellbore operation, the system comprising:

a tool string formed of a tubular to be disposed within the wellbore;

a workpiece configured to be conveyed into the wellbore using the tool string, the workpiece configured to perform the non-drilling wellbore operation within the wellbore;

at least one sensor along the tool string for sensing the downhole condition, the at least one sensor being configured to be conveyed into the wellbore with the workpiece using the tool string a processing section for receiving data relating to the downhole condition and a transmitter associated with the processing section and configured to transmit the data relating to the downhole condition to the surface, wherein the transmitter uses mud pulse telemetry;

wherein the at least one downhole condition is a condition from the set consisting of torque, weight, tool string compression, tool string tension, speed of tool string rotation, vibration, and direction of tool string rotation.

11. The system of claim 10, further comprising a controller positioned at the surface that is configured to control the workpiece.

12. A condition sensing tool for use within a wellbore during a non-drilling operation to detect at least one downhole condition within the wellbore, the condition sensing tool being deployable via a tubular tool string and comprising:

an outer housing defining an axial fluid flowbore therethrough and being coupled to the tubular tool string;

a sensor section formed in the housing; and at least one sensor in the sensor section for detecting the at least one non drilling downhole condition from the set of conditions consisting essentially of torque, weight, tool string compression, tool string tension, speed of tool string rotation, vibration, and direction of tool string rotation, wherein the outer housing, the sensor section, and the at least one sensor are configured to be conveyed into the wellbore with the tubular tool string; and a power section within the housing for supplying power to the sensor section.

13. A condition sensing tool for use within a wellbore during a non-drilling operation to detect at least one downhole condition within the wellbore, the condition sensing tool being deployable via a tubular tool string and comprising:

an outer housing defining an axial fluid flowbore therethrough and being coupled to the tubular tool string;

a sensor section formed in the housing; and at least one sensor in the sensor section for detecting the at least one non drilling downhole condition from the set of conditions consisting essentially of torque, weight, tool string compression, tool string tension, speed of tool string rotation, vibration, and direction of tool string rotation, wherein the outer housing, the sensor section, and the at least one sensor are configured to be conveyed into the wellbore with the tubular tool string; and a processing section for receiving data relating to the downhole condition and transmitting the data to a remote receiver.

14. A method of performing a non-drilling downhole wellbore operation comprising:

integrating a workpiece and a condition sensing tool into a tool string;

disposing the tool string into a wellbore;

actuating the workpiece to conduct a non-drilling downhole operation;

detecting at least one downhole condition with the condition sensing tool; and wherein a) the workpiece comprises a fishing tool for engaging a stuck member within the wellbore;

b) the non-drilling downhole operation comprises a fishing operation to remove a stuck member from the wellbore; and c) the condition sensing tool detects weight and torque.

15. A method of performing a non-drilling downhole wellbore operation, comprising:

integrating a workpiece and a condition sensing tool into a tool string formed of a tubular;

conveying the workpiece and the condition sensing tool into a wellbore using the tool string formed of the tubular;

actuating the workpiece to conduct a non-drilling downhole operation;

detecting at least one down hole condition with the condition sensing tool; and transmitting information indicative of the downhole condition to a surface location, wherein:

a) the workpiece comprises an anchor latch;

b) the non-drilling downhole operation comprises unthreading of a threaded connection within the wellbore; and c) the condition sensing tool detects tool string compression and tool string tension.

16. A method of performing a non-drilling downhole wellbore operation comprising:

integrating a workpiece and a condition sensing tool into a tool string;

disposing the tool string into a wellbore;

actuating the workpiece to conduct a non-drilling downhole operation;

detecting at least one downhole condition with the condition sensing tool; and wherein:

a) the workpiece comprises a packer;

b) the non-drilling downhole operation comprises retrieval of the packer from a set position within the wellbore; and c) the condition-sensing tool detects torque and weight.

* * * * *

UNITED STATES PATENT AND TRADEMARK OFFICE

CERTIFICATE OF CORRECTION

PATENT NO. : 7,591,314 B2
APPLICATION NO. : 10/776089
DATED : September 22, 2009
INVENTOR(S) : James A. Sonnier et al.

It is certified that error appears in the above-identified patent and that said Letters Patent is hereby corrected as shown below:

In Claim 9, at column 10, line 17, please delete "claim 1" and insert therefor -- claim 3 --.

Signed and Sealed this

Tenth Day of November, 2009

David J. Kappos

David J. Kappos
*Director of the United States Patent and Trademark Office*